US010571186B2

(12) United States Patent
Lee

(10) Patent No.: US 10,571,186 B2
(45) Date of Patent: Feb. 25, 2020

(54) REFRIGERATOR

(71) Applicant: LG Electronics Inc., Seoul (KR)

(72) Inventor: Sanggyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/964,448

(22) Filed: Apr. 27, 2018

(65) Prior Publication Data

US 2019/0041123 A1 Feb. 7, 2019

(30) Foreign Application Priority Data

Aug. 4, 2017 (KR) ..... 10-2017-0099039

(51) Int. Cl.
*F25D 25/02* (2006.01)
*A47B 88/48* (2017.01)

(52) U.S. Cl.
CPC ..... *F25D 25/025* (2013.01); *A47B 88/48* (2017.01); *A47B 2210/0002* (2013.01); *A47B 2210/175* (2013.01)

(58) Field of Classification Search
CPC ..... F25D 25/025; F25D 23/067; A47B 88/48; A47B 88/60; A47B 2088/4675; A47B 2210/0002; A47B 2210/175
See application file for complete search history.

(56) References Cited

U.S. PATENT DOCUMENTS 4,121,878 A * 10/1978 Lokken ..... A47B 88/467 312/334.45
4,615,095 A * 10/1986 Bessinger ..... A47B 88/467 29/407.1
4,747,704 A * 5/1988 Nelson ..... A47B 88/487 384/19
8,562,088 B2 * 10/2013 Lim ..... F25D 25/025 312/334.1
9,285,160 B1 * 3/2016 Kang ..... F25D 25/025
10,113,788 B2 * 10/2018 Zhang ..... A47B 88/00
10,145,605 B2 * 12/2018 Yang ..... F25D 23/02
(Continued)

FOREIGN PATENT DOCUMENTS

DE 102013015463 2/2015
GB 702906 1/1954

OTHER PUBLICATIONS

European Search Report in European Application No. 18166814.6, dated Nov. 16, 2018, 10 pages.

*Primary Examiner* — Hanh V Tran
(74) *Attorney, Agent, or Firm* — Fish & Richardson P.C.

(57) ABSTRACT

A refrigerator includes a cabinet defining a compartment, a drawer including a first roller at a rear end of the drawer and a guide rib, a second roller that is located at a front portion of the compartment and supports the guide rib, first roller guides that is located at respective side surfaces of the compartment and defines a movement path of the first roller, and a movable support that supports the drawer from below the drawer and discharges together with the drawer. The guide rib includes a first portion extending from a front of the drawer toward the rear end of the drawer in a direction that slopes downward relative to a bottom surface of the compartment, and each first roller guide includes a rear portion extending rearward in a direction corresponding to a slope of the first portion relative to the bottom surface of the compartment.

20 Claims, 6 Drawing Sheets

(56) References Cited

U.S. PATENT DOCUMENTS

| | | | | |
|---|---|---|---|---|
| 2006/0049731 | A1* | 3/2006 | Choi | F25D 25/025 312/330.1 |
| 2008/0289355 | A1* | 11/2008 | Kang | F25C 1/24 62/344 |
| 2012/0262044 | A1* | 10/2012 | Vulava | F25D 23/021 312/404 |
| 2012/0273504 | A1* | 11/2012 | Rackley | F25D 25/025 220/592.02 |
| 2013/0257253 | A1* | 10/2013 | Haltmeyer | F25D 25/025 312/404 |
| 2013/0257254 | A1* | 10/2013 | Austin | F25D 25/025 312/404 |
| 2014/0252938 | A1* | 9/2014 | Kim | F25D 23/00 312/405.1 |
| 2014/0265808 | A1* | 9/2014 | Kendall | F25D 27/00 312/408 |
| 2016/0040922 | A1* | 2/2016 | Ha | F25D 23/006 312/404 |
| 2016/0334159 | A1* | 11/2016 | Hong | F25D 23/028 |
| 2017/0198963 | A1* | 7/2017 | Hanson | F25D 25/025 |
| 2018/0187965 | A1* | 7/2018 | Seo | F25D 25/025 |

* cited by examiner

REFRIGERATOR

CROSS-REFERENCE TO RELATED APPLICATIONS

This application claims the benefit of Korean Patent Application No. 10-2017-0099039, filed on Aug. 4, 2017, which is hereby incorporated by reference as if fully set forth herein.

FIELD

The present disclosure relates to a refrigerator and, more particularly, to a refrigerator including a drawer that discharges more conveniently.

BACKGROUND

A refrigerator may keep food fresh by cooling a storage compartment based on repeating a refrigeration cycle.

For example, a refrigerator may include a compressor that compresses refrigerant, through a refrigeration cycle, into high-temperature and high-pressure refrigerant. The refrigerant compressed by the compressor may cool air while passing through a heat exchanger, and the cooled air may be supplied into a freezing compartment or a refrigerating compartment.

The refrigerator may have a configuration in which the storage compartment is divided into the refrigerating compartment and the freezing compartment. For example, the freezing compartment may be located at the upper side, and the refrigerating compartment may be located at the lower side. A door may be provided on the front side of the refrigerator to preserve cold air in the refrigerating compartment and the freezing compartment.

A side-by-side-type refrigerator may be configured such that the freezing compartment and the refrigerating compartment are arranged side by side on the left and right sides, respectively. In some examples, the refrigerator may include a single storage compartment that may be located at the upper side or the lower side, and the storage compartment may be configured to be opened by two doors arranged side by side.

In some examples, in order to reduce spread of smell from food to an inside of the refrigerator, the accommodating space such as the refrigerating compartment may include a plurality of storage compartments configured to receive different types of food, and drawers configured to insert into the storage compartments.

For example, a drawer may be slidably discharged forward from the inside of the storage compartment via a slide rail device. One example of such a slide rail device includes a fixed rail, which is coupled to each of opposite inner walls of the storage compartment, a fixing movable rail, which is coupled to each sidewall of the drawer in order to guide the sliding operation of the drawer, and an extension movable rail, which is located between the fixing movable rail. The fixed rail may extend the discharge length of the fixing movable rail and the slide relative to both the rails.

In some cases, the slide rail device described above may increase the price of the drawer due to the use of the sliding rails that overlap each other.

In some cases, the slide rail device may reduce the capacity of the drawer because it may include a number of rails that overlap each other, for example, the fixed rail, the fixing movable rail, and the extension movable rail.

In some cases, a user may need to apply force to the drawer against frictional force between the rails until the drawer is completely discharged from or inserted into the storage compartment.

In some cases, the drawer may perform a linear movement according to the linear characteristics of the sliding rails. For example, the drawer may not discharge in a direction tilted downward, which may make it difficult for the user to view an inside of the drawer in its entirety.

SUMMARY

One object of the present disclosure is to provide a refrigerator, which may ensure that a user does not need to continuously apply force in order to introduce or discharge a drawer into or from a storage compartment.

Another object of the present disclosure is to provide a refrigerator, in which a drawer is tilted forward or downward when discharged to a maximum extent from a storage compartment.

Another object of the present disclosure is to provide a refrigerator having a drawer which have a reduced price compared to another slide rail device.

Another object of the present disclosure is to provide a drawer, which may increase a maximum capacity thereof by preventing rails from overlapping each other.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

According to one aspect of the subject matter described in this application, a refrigerator includes a cabinet that defines a storage compartment and an opening at a front side for the storage compartment, a drawer that is located in the storage compartment, that is configured to discharge from the storage compartment in a discharge direction, and that includes a first roller located at a rear end of the drawer and a guide rib that extends in the discharge direction, a second roller located at a front portion of the storage compartment and configured to support a bottom surface of the guide rib of the drawer, first roller guides located at respective side surfaces of the storage compartment that face each other, the first roller guides defining a movement path of the first roller, and a movable support that is located vertically below the drawer in the storage compartment, that is configured to discharge together with the drawer, and that is configured to support the drawer. The guide rib includes a first portion that extends from a front end of the drawer toward the rear end of the drawer in a direction that slopes downward with respect to a bottom surface of the storage compartment. Each first roller guide includes a rear portion that extends rearward in a direction corresponding to a slope of the first portion of the guide rib with respect to the bottom surface of the storage compartment.

Implementations according to this aspect may include one or more of the following features. For example, the guide rib may further include a second portion that extends from the first portion toward the rear end of the drawer in a direction that slopes upward relative to the bottom surface of the storage compartment. The guide rib may further include a third portion that extends from the second portion toward the rear end of the drawer in a direction that slopes downward with respect to the bottom surface of the storage compartment. The guide rib may include a stopper that protrudes downward from a rear end of the guide rib and that is configured to interfere with the second roller. In some examples, each first roller guide may include a first lower guide surface located vertically below the first roller, and a first upper guide surface located vertically above the first roller and configured to block separation of the first roller in an upward direction from the first roller guides.

In some implementations, the first upper guide surface may include a first protrusion that protrudes downward from the first upper guide surface and that extends in a longitudinal direction of the first roller guides in which the first roller has an outer circumferential surface that defines an accommodating groove configured to receive the first protrusion. The first roller guides may be located vertically below the guide rib. The movable support may include a support frame located at a bottom surface of the storage compartment and configured to discharge forward together with the drawer, and a front roller located at a front portion of the support frame and configured to support the drawer. The drawer may further include a roller accommodating portion that defines an open bottom side configured to receive the front roller. The roller accommodating portion extends rearward from the front end of the drawer by an extension length, and the drawer may be configured to discharge forward from the storage compartment by a distance that is greater than the extension length based on the movable support discharging together with the drawer.

In some implementations, the movable support may further include a rear roller located at a rear portion of the support frame, and the refrigerator may further include second roller guides that are located at the respective side surfaces of the storage compartment and that define a movement path of the rear roller. In some examples, each second roller guide may include a second lower guide surface located vertically below the rear roller, and a second upper guide surface located vertically above the rear roller and configured to block separation of the rear roller in an upward direction from the second roller guides.

In some examples, the rear roller may include an upper roller and a lower roller located vertically below the upper roller, and each of the upper and lower rollers has an outer circumferential surface that defines a groove. In some examples, each second roller guide may include a second lower protrusion that protrudes from the second lower guide surface, that is configured to insert into the groove in the lower roller, and that is configured to guide movement of the lower roller, and a second upper protrusion that protrudes from the second upper guide surface, that is configured to insert into the groove in the upper roller, and that is configured to guide movement of the upper roller.

In some implementations, the guide rib may protrude from the rear end of the drawer in which the first roller protrudes rearward from the rear end of the drawer by a predetermined distance. The guide rib may further include a first coupling portion that connects the first portion to the second portion and that is curved by a first curvature. The guide rib may further include a second coupling portion that connects the second portion to the third portion and that is curved by a second curvature greater than the first curvature. In some examples, the stopper may include a front surface that is curved and that is configured to contact the second roller.

In some implementations, the guide rib may include a guide protrusion that protrudes from the bottom surface of the guide rib and that extends in a longitudinal direction of the guide rib, where the second roller may include a roller that has an outer circumferential surface that defines an accommodating groove configured to receive the guide protrusion. The guide rib may include a guide protrusion that protrudes from the bottom surface of the guide rib and that extends toward the rear end of the drawer along the directions of the first, second, and third portions. The roller accommodating portion may include a rear end surface that is spaced apart from the front end of the drawer by the extension length, and that is configured to receive pressure from the front roller based on the movable support discharging together with the drawer.

It is to be understood that both the foregoing general description and the following detailed description of the present disclosure are exemplary and explanatory and are intended to provide further explanation of the present disclosure as claimed.

DETAILED DESCRIPTION

Figure 1:
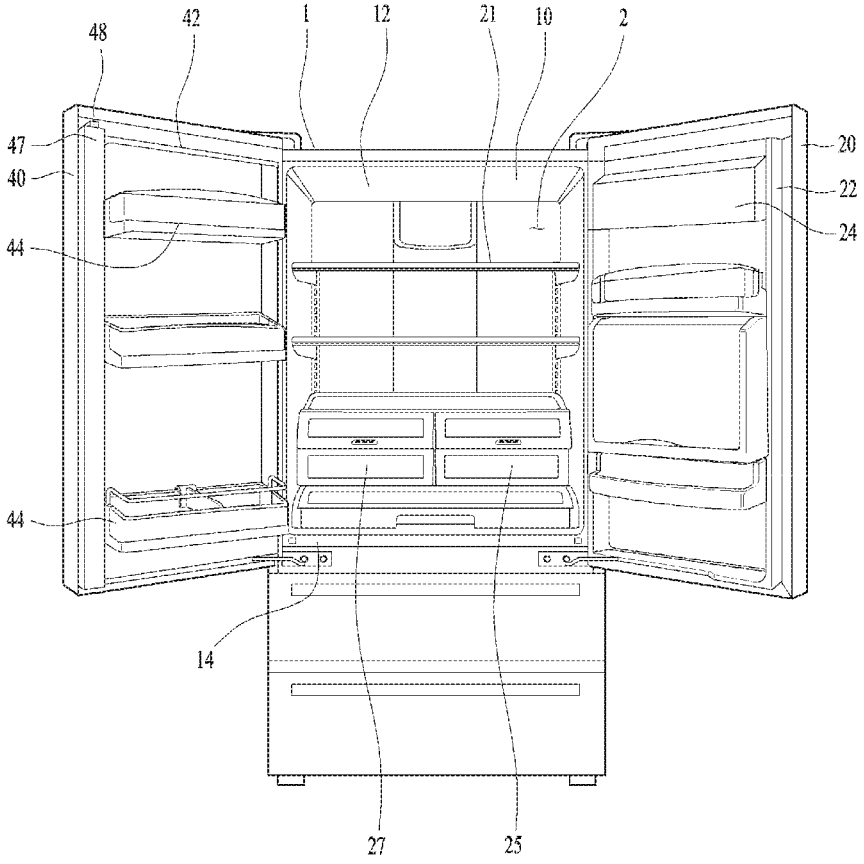
FIG. 1 is a front view illustrating an example refrigerator.

FIG. 1 is a front view illustrating a refrigerator according to an implementation of the present disclosure. Referring to FIG. 1, the refrigerator according to the implementation includes a cabinet 1, which defines the external appearance of the refrigerator, and a storage space 2, which is defined in the cabinet 1 and in which food may be stored.

In some example, the refrigerator may include a machine room at the rear of the storage space 2, and the machine room may include an evaporator of a refrigeration cycle, which serves to generate cold air and supply the cold air to the storage space 2, a compressor, which compresses refrigerant, and a condenser, which condenses and transmits the compressed refrigerant to the evaporator.

The external appearance of the storage space 2 may be defined by an inner case 10, which is provided inside the cabinet 1. The inner case 10 may include a top wall 12 and a bottom wall 14, which form the inner surface of the storage space 2, and the front side of the storage space 2 may be open in order to allow a user to access the storage space 2 through the front side of the storage space 2. The top wall 12 defines the ceiling 12 of the storage space 2 or the top wall of the inner case 10.

The cabinet 1 is provided at the front side thereof with a first door 20, which is rotatably installed to the cabinet 1 so as to open or close one side of the storage space 2, and a second door 40, which is rotatably installed to the cabinet 1 so as to open or close the other side of the storage space 2.

For instance, when the first door 20 and the second door 40 close the front side of the storage space 2, the entire storage space 2 may be sealed.

A pillar 47 may be rotatably installed to the second door 40 so as to come into contact with the first door 20. The pillar 47 may generally have a rectangular shape and may be coupled to the second door 40 so as to be rotated relative to the second door 40. For instance, the pillar 47 may be positioned such that the rotated angle thereof relative to the second door 40 varies based on, for example, the angle by which the second door 40 is rotated relative to the storage space 2, or whether the first door 20 opens or closes the storage space 2.

The pillar 47 has a shorter length than the distance between the top wall 12 and the bottom wall 14 of the inner case 10 so as not to come into contact with the top wall 12 and the bottom wall 14. That is, even if the second door 40 is rotated to seal the storage space 2, the pillar 47 does not come into contact with both the top wall 12 and the bottom wall 14. In some examples, the inner case 10 may not include an element that is disposed on the top wall 12 and the bottom wall 14 and that restrains the rotation of the pillar 47, in which each of the top wall 12 and the bottom wall 14 may form a single plane in its entirety.

In some examples, a pillar protrusion 48 is provided on the top side of the pillar 47. The pillar protrusion 48 protrudes so as not to come into contact with the top wall 12, i.e. the ceiling 12.

The first door 20 may include a door dike 22, which defines the rear appearance of the first door 20. In addition, the second door 40 may include a door dike 42, which defines the rear appearance of the second door 40.

In some examples, baskets 24 and 44 may be installed to the respective door dikes 22 and 42, and may be used to store various shapes of food therein. For instance, the basket 24, which is installed to the first door 20, which is not provided with the pillar 47, does not interfere with the pillar 47 when the first door 20 is rotated, therefore, the basket 24 may have an angled corner. Accordingly, the basket 24 may store an increased amount of food compared to a basket having a rounded corner.

The storage space 2 may include a plurality of shelves 21, which are provided one above another. The storage space 2 may be divided into a plurality of storage compartments by the shelves 21. Some of the divided storage compartments may be divided by partitions, and each of the divided storage compartments may include a drawer, which may be introduced into or discharged therefrom.

In FIG. 1, the refrigerator includes a left storage compartment and a right storage compartment, which are disposed in the lower region and are divided by a partition, for example. The right storage compartment may include a first drawer 25, which is disposed near the first door 20, and the left storage compartment may include a second drawer 27, which is located near the second door 40. For instance, the first drawer 25 and the second drawer 27 may be disposed in the same horizontal plane. In some example, the first drawer 25 and the second drawer 27 may be arranged on the left and right sides, respectively, at a same height within the storage space 2. The first drawer 25 and the second drawer 27 may be discharged independently of each other.

The first drawer 25 and the second drawer 27 may have a same width. That is, the first drawer 25 and the second drawer 27 may have the same storage capacity, and may be replaced with each other. Assuming that the first drawer 25 and the second drawer 27 have different widths, and thus different shapes, the first drawer 25 and the second drawer 27 need to be differently manufactured, which may inevitably increase manufacturing costs. On the other hand, assuming that the two drawers 25 and 27 have the same shape, manufacturing costs thereof may be advantageously reduced.

In some implementations, when the first door 20 is opened and the first drawer 25 is discharged in the state in which the second door 40 seals the storage space 2, the pillar 47 may not be located in the path along which the first drawer 25 is discharged.

In some implementations, the first door 20 and the second door 40 may have a same width. The first door 20 and the second door 40 may share some of the production processes thereof, which may reduce the production cost of the doors 20 and 40.

Hereinafter, an example drawer 100 of the refrigerator will be described in detail with reference to FIGS. 2 to 4B.

Figure 2:
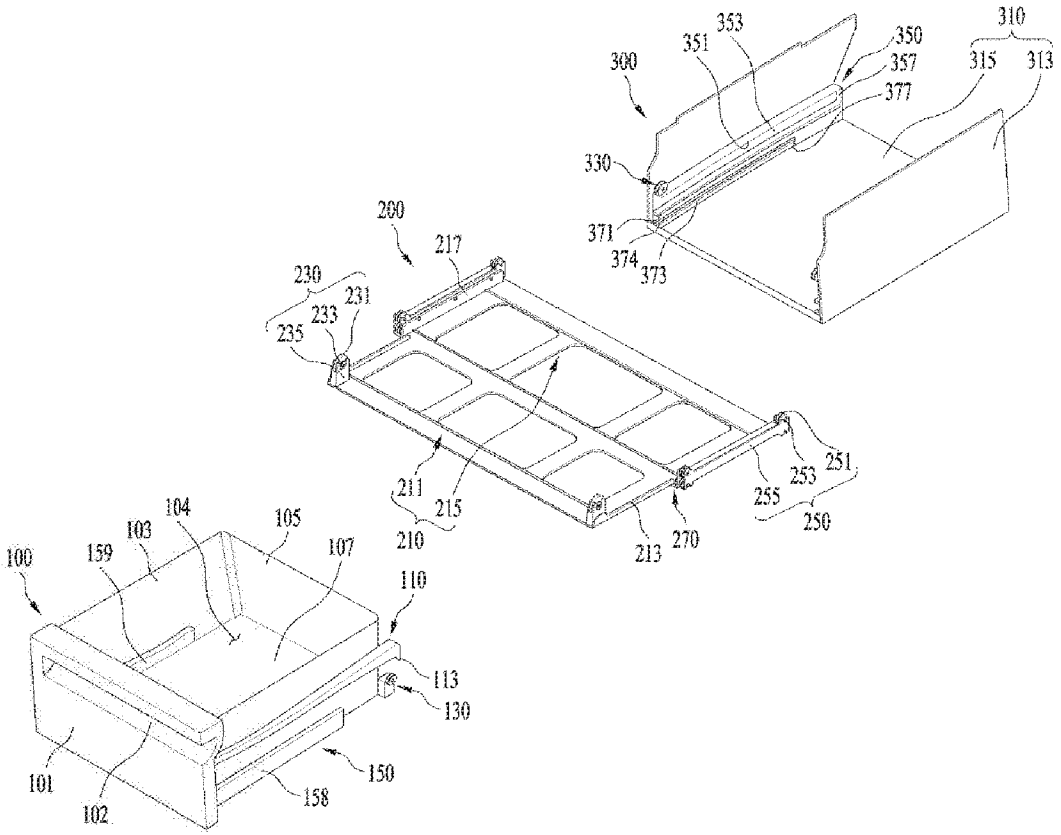
FIG. 2 is an exploded perspective view illustrating an example drawer, an example storage compartment, and an example movable support unit of the refrigerator illustrated in FIG. 1.
Figure 3:
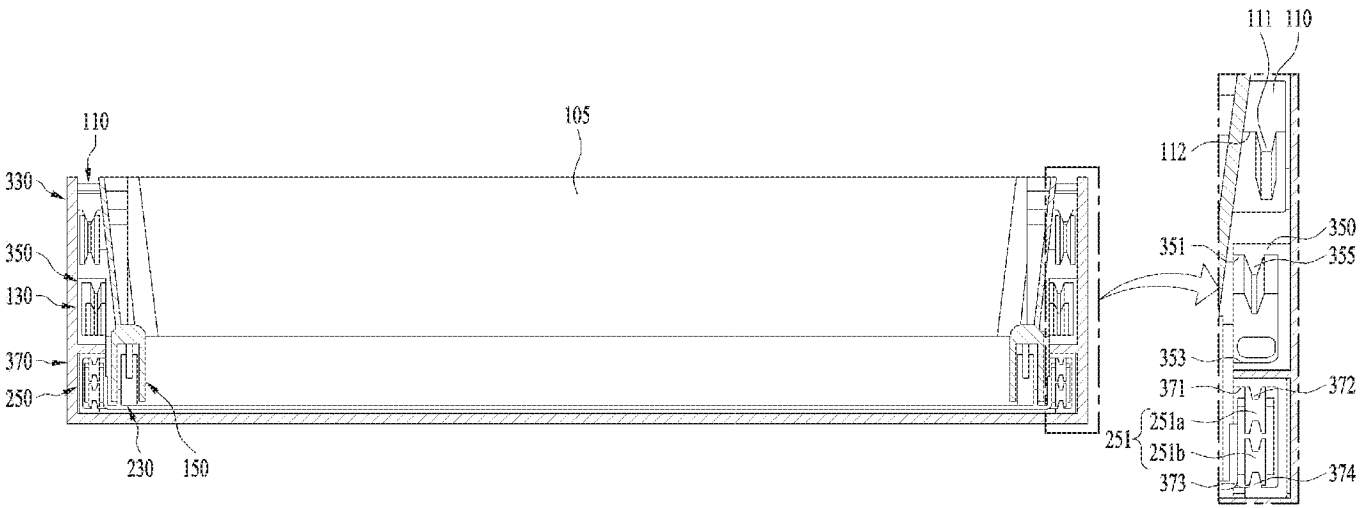
FIG. 3 is a cross-sectional view illustrating the drawer, the storage compartment, and the movable support unit illustrated in FIG. 2, viewing from the front side of the refrigerator.
Figure 4A:
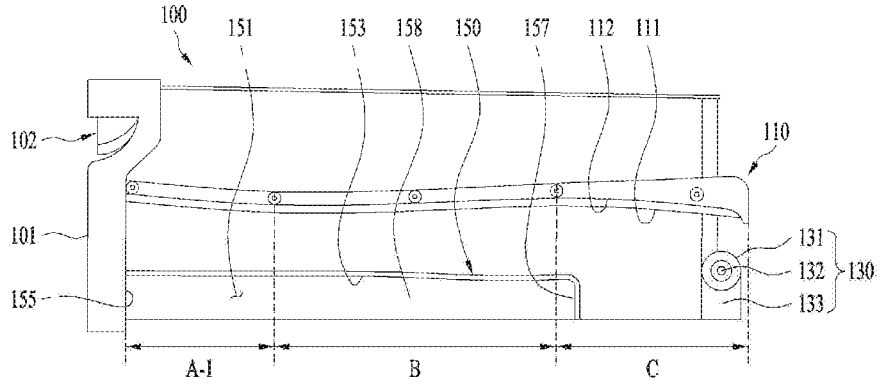
FIGS. 4A and 4B are side views illustrating the drawer and an example side surface of the storage compartment illustrated in FIG. 2.
Figure 4B:
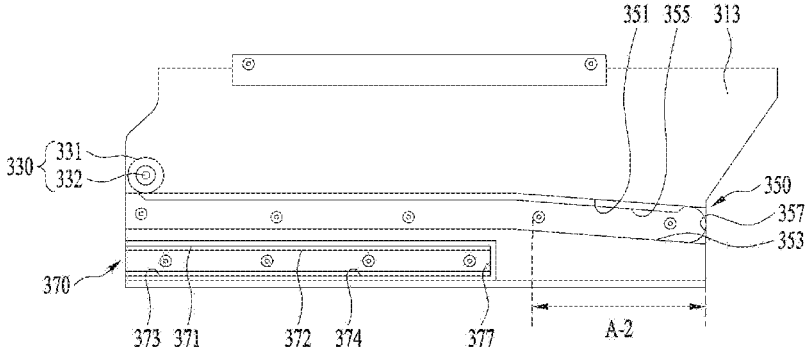

FIG. 2 is an exploded perspective view illustrating an example coupling between the drawer 100, an example storage compartment 300, and an example movable support unit 200 illustrated in FIG. 1, FIG. 3 is a partial cross-sectional view illustrating the drawer 100, the storage compartment 300, and the movable support unit 200 illustrated in FIG. 2 when viewed from the front side, and FIGS. 4A and 4B are side views illustrating the drawer 100 and an example side surface of the storage compartment 300 illustrated in FIG. 2.

Hereinafter, for the convenience of description, the first drawer 25 provided in the right storage compartment will be described. The right storage compartment is referred to as the storage compartment 300, and the first drawer 25 is referred to as the drawer 100. In addition, the following description related to the drawer 100 may be equally applied to the first drawer 25 provided in the right storage compartment or the second drawer 27 provided in the left storage compartment.

The drawer 100 provides an inner space in which food may be stored, and is located in the storage compartment 300 and configured to introduce to or discharged from the storage compartment 300. The drawer 100 includes a drawer bottom surface 107, which defines the bottom of the drawer 100, a drawer front surface 101, which extends upward from the edge of the drawer bottom surface 107 and is connected thereto, a pair of drawer side surfaces 103, and a drawer rear surface 105, which is located at an opposite side of the drawer front surface 101.

The inner space of the drawer 100 is defined as the space, which has an open top side and is surrounded by the drawer bottom surface 107, the drawer front surface 101, the pair of drawer side surfaces 103, and the drawer rear surface 105.

The drawer 100 includes a first roller unit 130, which may be introduced into or discharged from the storage compartment 300, and a guide rib 110, which extends in the discharge direction. For example, the drawer 100 may discharge in a direction forward from the storage compartment 300.

In some examples, a pair of guide ribs 110 may be provided on opposite side surfaces of the drawer 100 and may protrude therefrom, respectively. The guide ribs 110 extend, respectively, from the front end to the rear end of the drawer 100. Each guide rib 110 is disposed on a second roller unit 330, which will be described later, and is movably supported by the second roller unit 330.

In some implementations, a pair of first roller units 130 may be provided on the rear end of opposite side surfaces of the drawer 100. Each first roller unit 130 includes a first rotating shaft 132, a first roller 131, which rotates about the first rotating shaft 132, and a first shaft support portion, which rotatably supports the first rotating shaft 132. The first roller unit 130 moves along a movement path defined by a first roller guide 350, which will be described later.

In some examples, the storage compartment 300 may include the second roller unit 330, which movably supports the bottom surface of the guide rib 110, and the first roller guide 350, which provides the movement path of the first roller 131.

In some implementations, a pair of second roller units 330 may be located on opposite inner walls of the storage compartment 300, respectively. Each second roller unit 330 may include a second rotating shaft 332, which is rotatably provided on each of the inner walls of the storage compartment 300, and a second roller 331, which rotates about the second rotating shaft 332. The second roller unit 330 movably supports the bottom surface of the guide rib 110. That is, the weight of the drawer 100 is applied to the second roller 331.

In some implementations, a pair of first roller guides 350 may be located on opposite inner surfaces of the storage compartment 300 so as to protrude therefrom, respectively. The first roller guides 350 extend from the front end portion to the rear end portion of the storage compartment 300. Each first roller guide 350 provides the movement path of the first roller unit 130 so as to allow the first roller unit 130 to move along the first roller guide 350. In addition, the first roller guide 350 may support the weight of the drawer 100 via the first roller 131.

For example, the guide rib 110 and the first roller unit 130 of the drawer 100 are movably supported by the second roller unit 330 and the first roller guide 350 of the storage compartment 300, respectively, so that the drawer 100 may be introduced into or discharged from the storage compartment 300.

In some examples, the guide rib 110 includes a first slope A-1, which is inclined rearward and downward from the front end of the drawer 100. Since the second roller unit 330 is disposed under the guide rib 110 so as to movably support the first slope A-1, the first slope A-1 forms the bottom surface of a specific section of the guide rib 110, which is inclined rearward and downward. In this case, the second roller unit 330 is provided on the front end portion of the storage compartment 300.

The top surface of the guide rib 110 may be inclined rearward and downward along with the bottom surface of the guide rib, but is not limited thereto. The top surface may not be inclined, or may be formed with a slope, which is inclined in the opposite direction. A second slope B and a third slope C, which will be described later, form the bottom surface of the guide rib 110 in respective specific sections.

While the first slope A-1 moves on the second roller unit 330, the force of pressure applied to the first slope A-1 by the second roller unit 330 is divided into force that acts in the upward direction of the drawer 100 and force that acts in the rearward direction of the drawer 100. Thus, while the first slope A-1 is located on the second roller 331, the drawer 100 may be introduced automatically into the storage compartment 300 by the force acting in the rearward direction of the drawer 100 even if the user applies no force.

The drawer 100 accommodated in the storage compartment 300 may not be unintentionally discharged from the storage compartment 300. For example, when repulsive force is generated in a direction opposite to a direction of force that the user excessively applies to the drawer 100 in order to push the drawer 100 into the storage compartment 300, or when the refrigerator is tilted, the drawer 100 accommodated in the storage compartment 300 may be unintentionally discharged by a predetermined length. However, the force acting in the rearward direction of the drawer 100 may prevent the drawer 100 from being easily discharged from the storage compartment 300.

In some examples, since the second roller unit 330 is located on the front end portion of the storage compartment 300, the front end portion of the drawer 100 is raised or lowered relative to the rear end portion while the first slope A-1 moves on the second roller unit 330. In other words, there may occur a pitching phenomenon of the drawer 100. In this case, food and the like in the inner space of the drawer 100 may be damaged.

In order to prevent the pitching phenomenon of the drawer 100 described above, the rear end portion of the first roller guide 350 may be inclined rearward and downward so as to correspond to the inclination angle of the first slope A-1. That is, the inclination angle of a rear end portion A-2 of the first roller guide 350 may be the same as the inclination angle of the first slope A-1. The first roller unit 130 is provided on the rear end portion of the drawer 100.

Thus, the drawer 100 is raised by a predetermined height while maintaining the horizontal state relative to the ground while the first slope A-1 moves on the second roller 331. The predetermined height corresponds to a distance between the front end and the rear end of the first slope A-1.

The first slope A-1 may be manufactured in various ways according to the size of the drawer 100, and for example, may have an angle of approximately 5 degrees and a section length of approximately 120 mm.

In some examples, the guide rib 110 may further include the second slope B, which is inclined rearward and upward of the first slope A-1.

In a state in which the drawer 100 maintains the horizontal state relative to the ground, the second slope B begins to move on the second roller unit 330. While the second slope B moves on the second roller unit 330, the force of pressure applied to the second slope B by the second roller unit 330 is divided into force that acts in the upward direction of the drawer 100 and force that acts in the forward direction of the drawer 100. Here, the force of the pressure applied to the second slope B by the second roller unit 330 is the force attributable to the weight of the drawer 100. Thus, while the second slope B is located on the second roller 331, the drawer 100 may be discharged automatically from the storage compartment 300 by the force acting in the forward direction of the drawer 100 even if the user applies no force. The drawer 100 is accelerated by the force acting in the rearward direction of the drawer 100 during the discharge thereof.

When the operation of the first slope A-1 moving on the second roller unit 330 ends, and the operation of the second slope B moving on the second roller unit 330 begins, the drawer 100 in the horizontal state begins to be gradually tilted forward and downward of the drawer 100.

The inclination angle of the drawer 100 continuously increases while the second slope B moves on the second roller unit 330. The inclination angle of the second slope B may be smaller than the inclination angle of the first slope A-1, and the length of the second slope B is greater than the length of the first slope A-1.

For example, the second slope B may have an inclination angle of approximately 2.7 degrees and a section length of approximately 145.6 mm. Thus, the drawer 100 may be tilted within a range from approximately 0 degrees to approximately 5 degrees from the horizontal state relative to the ground.

In some examples, while the second slope B moves on the second roller unit 330, the section of the first roller guide 350 in which the first roller unit 130 moves is in the horizontal state relative to the ground.

In addition, the guide rib 110 may further include the third slope C, which is inclined rearward and downward from the second slope B. That is, the third slope C is inclined forward and upward.

While the second slope B moves on the second roller unit 330, the third slope C begins to be tilted forward and downward, and the angle between the third slope C and the ground gradually decreases.

When the operation of the second slope B moving on the second roller unit 330 ends, the third slope C is in the forwardly and upwardly tilted state. For instance, the inclination angle of the third slope C is smaller than the inclination angle of the third slope C relative to the ground when the drawer 100 is in the horizontal state relative to the ground.

While the third slope C moves on the second roller unit 330, the force of pressure applied to the third slope C by the second roller unit 330 is divided into force that acts in the upward direction of the drawer 100 and force that acts in the rearward direction of the drawer 100. Here, the force of pressure applied to the third slope C by the second roller unit 330 is the force by the weight of the drawer 100.

For example, while the third slope C moves on the second roller unit 330, the drawer 100 is gradually decelerated by the force acting in the rearward direction of the drawer 100.

In some examples, the third slope C has a section length smaller than the section length of the second slope B, and has an inclination angle greater than the inclination angle of the second slope B.

For example, the third slope C may have an inclination angle of approximately 6.3 degrees and a section length of approximately 125 mm. In this case, when the operation of the third slope C moving on the second roller unit 330 ends, the inclination angle of the drawer 100 relative to the ground is approximately 4 degrees, which is smaller than 5 degrees.

In some implementations, when the drawer 100 is tilted forward and downward, the user who stands in front of the refrigerator may easily view the inside of the drawer 100. To this end, the drawer 100 further includes a stopper 113, which prevents the drawer 100 from being further discharged when the operation of the third slope C moving on the second roller unit 330 ends.

The stopper 113 is provided on the rear end of the guide rib 110 so as to protrude downward. The downwardly protruding stopper 113 interferes with the second roller unit 330 to prevent the drawer 100 from being further discharged.

In some examples, the stopper 113 may have a curved front end surface to allow the drawer 100 to smoothly stop. The front end surface of the stopper 113 may have a predetermined curvature, and for example, may have the same curvature as the curvature of the second roller 331 of the second roller unit 330.

In addition, the inter-coupling portion of the first slope A-1 and the second slope B may be curved to have a first curvature, and the inter-coupling portion of the second slope B and the third slope C may be curved to have a second curvature. This serves to prevent the drawer 100 from rattling due to a collision between the respective slopes and the second roller unit 330 in the portion in which the inclination section is changed while the drawer 100 is discharged or introduced.

In consideration of the above-described example in which the first slope A-1 has an inclination angle of approximately 5 degrees and a section length of approximately 120 mm, the second slope B has an inclination angle of approximately 2.7 degrees and a section length of approximately 145.6 mm, and the third slope C has an inclination angle of approximately 6.3 degrees and a section length of approximately 125 mm, the first curvature may have a downwardly convex form and the radius of curvature thereof may be approximately 1000 mm, and the second curvature may have an upwardly convex form and the radius of curvature thereof may be approximately 700 mm.

The guide rib 110 may protrude from the rear end of the drawer 100, and the first roller unit 130 may be rearwardly spaced apart from the rear end of the drawer 100 by a predetermined distance so that the upper end portion of the rear end or the entire rear end of the drawer 100 is discharged from the storage compartment 300. For example, the first roller unit 130 may protrude rearward from the rear end of the drawer 100 by the predetermined distance. In this example, the drawer 100 may be fully discharged, the user may easily view the inside of the drawer 100.

For example, in the guide rib 110, a portion of the third slope C further extends rearward from the rear end of the drawer 100 so as to protrude therefrom, and the stopper 113 is rearwardly spaced apart from the rear end of the drawer 100. Thus, the second roller unit 330 is located at a position rearwardly spaced apart from the rear end of the drawer 100 when the drawer 100 is fully discharged. In addition, the first roller unit 130 is disposed such that a part or the entirety of the first roller 131 protrudes rearward from the rear end of the drawer 100 and such that a part or the entirety of the first shaft support portion protrudes rearward from the rear end of the drawer 100.

When the drawer 100 begins to be discharged, some of the weight of the drawer 100 is supported by the second roller unit 330 via the guide rib 110, and the remaining weight of the drawer 100 is supported by the first roller guide 350 via the first roller unit 130.

When the discharge of the drawer 100 proceeds, the center of gravity of the drawer 100 is located in front of the second roller unit 330 at a predetermined point in time. For instance, the drawer 100 begins to tilt forward. That is, the front end of the drawer 100 tries to move downward and the lower end of the drawer 100 tries to move upward. Thus, the first roller unit 130 located on the rear end of the drawer 100 also tries to move upward, and the first roller guide 350 no longer supports the weight of the drawer 100.

In this case, the first roller guide 350 includes a first lower guide surface 353 and a first upper guide surface 351, in order to prevent the first roller unit 130 from being separated from the first roller guide 350.

The first lower guide surface 353 is disposed under the first roller unit 130 and movably supports the first roller unit 130 to enable rolling of the first roller unit 130. The first upper guide surface 351 is upwardly spaced apart from the first lower guide surface 353 and is disposed on the first roller unit 130 to prevent the first roller unit 130 from being separated upward.

In some examples, the first upper guide surface 351 includes a first protrusion 355, which protrudes downward and extends in the longitudinal direction of the first roller guide 350 in order to minimize transverse shaking of the discharged drawer 100. In addition, the first roller 131 has a protrusion accommodating groove formed in the outer circumferential surface thereof so that the first protrusion 355 is inserted into the groove. The first protrusion 355 may have, for example, a V-shaped cross section, and the cross section of the protrusion accommodating groove may have a V-shaped shape so as to correspond to the shape of the first protrusion 355.

The drawer 100 may include, as components to minimize the transverse shaking of the discharged drawer 100, a guide protrusion 111, which protrudes from the bottom surface of the guide rib 110 and extends in the longitudinal direction of the guide rib 110, and a protrusion accommodating groove, which is formed in the outer circumferential surface of the second roller 331 so that the guide protrusion 111 is inserted into the groove.

Since the guide rib 110 is disposed on the first roller guide 350, the guide protrusion 111 is also disposed on the first protrusion 355. Thus, the transverse shaking of the upper end portion of the drawer 100 may be minimized by the guide protrusion 111 and the second roller 331, and the transverse shaking of the lower end portion of the drawer 100 may be minimized by the first protrusion 355 and the first roller 131.

Since the weight of the drawer 100, which is tilted when the discharge of the drawer 100 proceeds, is concentrated on some members that support the drawer 100, durability of the drawer 100 may be problematic, and moreover, vertical shaking may occur due to loose coupling between members.

Therefore, the refrigerator according to the implementation of the present disclosure may further include the movable support unit 200, which supports the weight of the drawer 100.

The movable support unit 200 is disposed between the drawer 100 and the bottom surface of the storage compartment 300. The movable support unit 200 does not overlap the guide rib 110 or the first roller guide 350 described above. Thus, the transverse width of the drawer 100 may be maximized.

In addition, the movable support unit 200 is provided in the storage compartment 300 so as to be dischargeable together with the drawer 100. In this case, the movable support unit 200 does not continuously support the weight of the drawer 100, and supports only a portion of the entire section of the drawer 100 that is discharged. This is because the drawer 100 moves vertically during the discharge thereof.

The movable support unit 200 described above includes a support frame 210, a front roller unit 230, which is provided at the front of the support frame 210 to movably support the drawer 100, and a rear roller unit 250, which is provided at the rear of the support frame 210.

The support frame 210 includes a first frame 211, which is provided on the bottom surface of the storage compartment 300 so as to be dischargeable, and a second frame 215, which is coupled to the rear end of the first frame 211.

The first frame 211 and the second frame 215 respectively have a plate shape in order to ensure the maximum vertical depth of the drawer 100, and are formed with openings at a constant interval in order to reduce the weight thereof.

The first frame 211 is provided with the front roller unit 230, which includes a front roller 231, which performs rotation, a front rotating shaft 233, which rotatably supports the front roller 231, and a front shaft support portion 235, which supports the front rotating shaft 233. A first fixing sidewall 213 is provided on the side end of the first frame 211 and extends upward to fixedly support the front shaft support portion 235.

The second frame 215 is provided on the side end thereof with a rear roller 251, which performs rotation, a rear rotating shaft 253, which rotatably supports the rear roller 251, and a bracket 255, which supports the rear rotating shaft 253.

The bracket 255 is fixed to a second fixing sidewall 217, which is provided on the side end of the second frame 215 to extend upward. In addition, the bracket 255 longitudinally extends a long length.

The rear roller 251 is provided on each of the front end and the rear end of the bracket 255. As illustrated in FIG. 3, a pair of rollers, each including an upper roller 251*a* and a lower roller 251*b*, are respectively provided on the front end and the rear end of the bracket 255. Thus, the rear roller unit 250 includes total four rollers.

The rear roller unit 250 moves along a movement path provided by a second roller guide 370.

The second roller guide 370 is provided on each of opposite inner walls of the storage compartment 300, and includes a second upper guide surface 371 and a second lower guide surface 373 downwardly spaced apart from the second upper guide surface 371.

The second lower guide surface 373 includes a second lower protrusion 374, which protrudes so as to be inserted into a groove in the lower roller 251*b* in order to guide movement of the lower roller 251*b*. The second upper guide surface 371 includes a second upper protrusion 372, which protrudes so as to be inserted into a groove in the upper roller 251*a* in order to guide movement of the upper roller 251*a*. In this example, it may be possible to minimize the transverse shaking of the movable support unit 200 when the movable support unit 200 is discharged from the storage compartment 300.

The second roller guide 370 is provided on the rear end thereof with a second blocking surface 377, which may prevent the support frame 210 from moving in the introduction direction of the drawer 100. The second blocking surface 377 is a vertically extending surface, which interconnects the rear ends of the second upper guide surface 371 and the second lower guide surface 373. The length of the second roller guide 370 from the front end to the second blocking surface 377 located on the rear end corresponds to the length of the movable support unit 200. Thus, when the movable support unit 200 is introduced into the storage compartment 300, the second roller guide 370 is located between a front end pressure surface 155 and a rear end pressure surface 157 so as not to move in the longitudinal direction.

In some examples, the width of the first frame 211 is less than the width of the second frame 215. Thus, a through-hole 270 is formed between the first fixing sidewall 213 and the second fixing sidewall 217 so that an outer cover 158 of a roller accommodating unit 150, which will be described later, is introduced into and discharged from the through-hole 270.

The length of the support frame 210 from the front end to the rear end thereof is smaller than the length of the drawer 100. When the drawer 100 is fully discharged, the support frame 210 is not fully discharged from the storage compartment 300, but a portion of the support frame 210 is discharged to support the weight of the drawer 100. The portion of the support frame 210 that is not discharged supports the discharged portion of the drawer 100 while being introduced into the storage compartment 300.

In some examples, the drawer 100 may further include the roller accommodating unit 150, which accommodates the front roller unit 230 therein.

The roller accommodating unit 150 is located close to the front end of the lower end portion of the drawer 100, and extends by a predetermined length from the front end to the rear end of the drawer 100. The roller accommodating unit 150 has an open bottom side, and includes a top support surface 153, which forms the top surface. The roller accommodating unit 150 further includes the front end pressure surface 155, the outer cover 158, an inner cover 159, and the rear end pressure surface 157, which extend downward from the periphery of the top support surface 153 and respectively form the front surface, the outer surface, the inner surface, and the rear surface.

In some examples, the roller accommodating unit 150 defines therein a roller accommodating space 151, which is the space in which the front roller unit 230 is accommodated. The roller accommodating space 151 is the space surrounded by the top support surface 153, the front end pressure surface 155, the outer cover 158, the inner cover 159, and the rear end pressure surface 157.

When the roller accommodating unit 150 is discharged, the front roller unit 230 is pressed by the rear end pressure surface 157 to thereby be moved forward. While the roller accommodating unit 150 is introduced, the front roller unit 230 is pressed by the front end pressure surface 155 to thereby be moved rearward.

In addition, when the drawer 100 is discharged and is tilted forward and downward, the movable support unit 200 may support the weight of the drawer 100 as the front roller unit 230 presses the top support surface 153 while being accommodated in the roller accommodating unit 150.

The roller accommodating unit 150 has a predetermined length, which is smaller than the distance that the drawer 100 is discharged so that the movable support unit 200 is discharged together with the drawer 100. Since the drawer 100 is fully discharged, the distance that the drawer 100 is discharged is equal to or greater than the length of the drawer 100.

In some examples, a base frame 310 illustrated in FIG. 2 includes a pair of side frames 313 and a lower frame 315. The side frames 313 form a pair of side surfaces of the storage compartment 300, and the lower frame 315 forms the bottom surface of the storage compartment 300.

Hereinafter, the discharge and introduction of the drawer 100 of the refrigerator according to the implementation of the present disclosure described above will be described in detail with reference to FIGS. 5A and 6C.

Figure 5A:
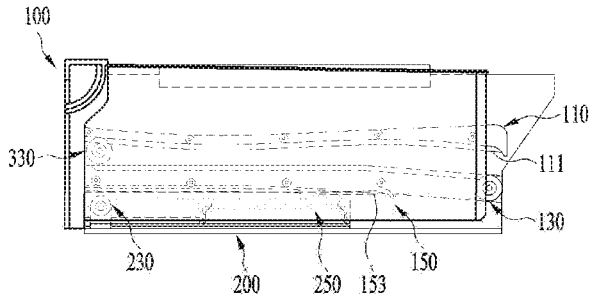
FIGS. 5A to 5D are views illustrating an example discharge operation of the drawer from the storage compartment.
Figure 5B:
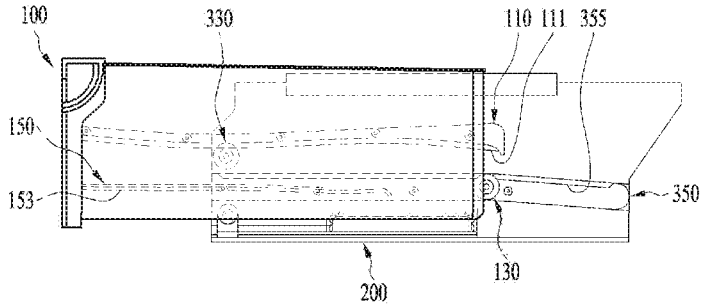
Figure 5C:
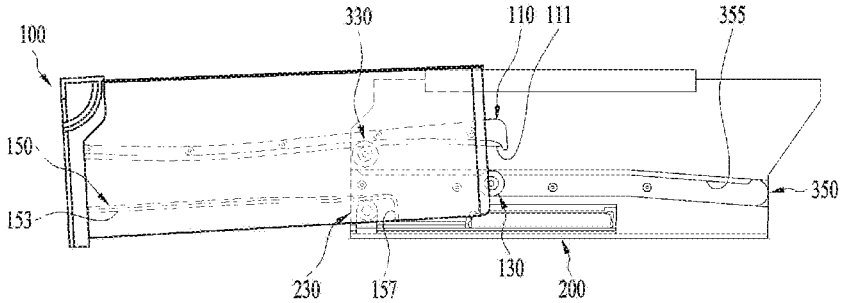
Figure 5D:
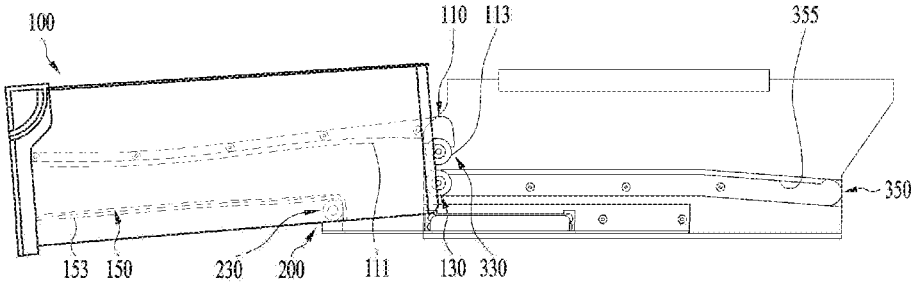
Figure 6A:
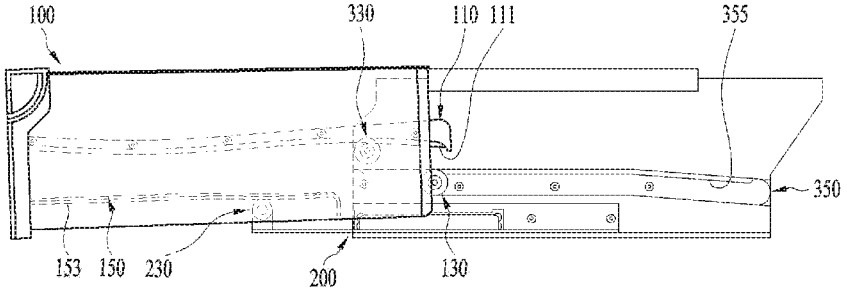
FIGS. 6A to 6C are views illustrating an example introduction operation of the discharged drawer into the storage compartment.
Figure 6B:
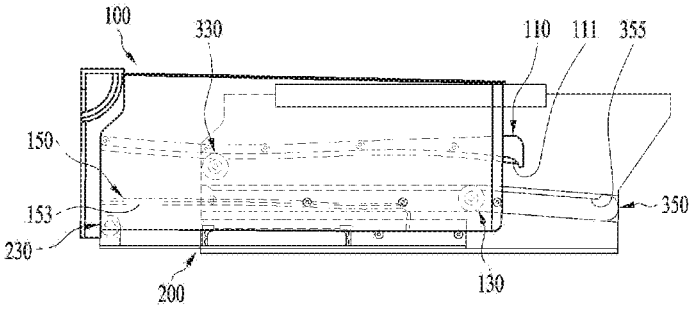
Figure 6C:
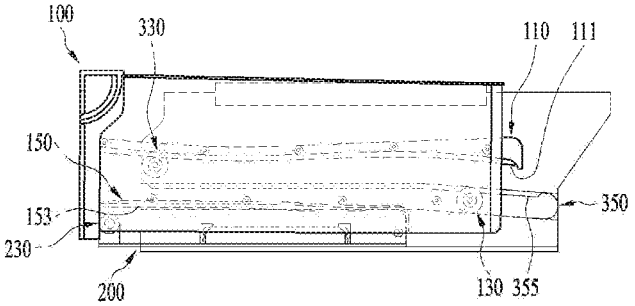

FIGS. 5A to 5D illustrate an example discharge operation of the drawer 100 from the storage compartment 300, and FIGS. 6A to 6C illustrate an example introduction operation of the discharged drawer 100 into the storage compartment 300.

Referring to FIG. 5A, there is illustrated the state in which the drawer 100 is introduced into the storage compartment 300. The second roller unit 330 supports the weight of the drawer 100 via the front end portion of the guide rib 110, and the first roller guide 350 supports the weight of the drawer 100 via the first roller 131, which is disposed on the rear end of the drawer 100.

For instance, the guide protrusion 111 is inserted into the second roller 331, the first protrusion 355 is inserted into the first roller 131, and the second upper protrusion 372 and the second lower protrusion 374 are respectively inserted into the upper roller 251*a* and the lower roller 251*b*. The state in which the protrusions are inserted into the respective rollers is continuously maintained during the introduction and discharge of the drawer 100.

In this case, the front roller 231 of the movable support unit 200 may support the weight of the drawer 100. However, the present disclosure is not limited thereto, and the case in which the movable support unit 200 is set to the position at which the movable support unit 200 does not support the weight of the drawer 100 in the state in which the drawer 100 is introduced, but supports the weight of the drawer 100 later is not excluded.

Referring to FIG. 5B, there is illustrated the state in which the user pulls out the drawer 100 accommodated in the storage compartment 300 to discharge the drawer 100. When the drawer 100 begins to be discharged from the storage compartment 300, the first slope A-1 moves on the second roller unit 330 and the first roller unit 130 moves along the rear end portion A-2 of the first roller guide 350. The drawer 100 moves forward while maintaining the horizontal state relative to the ground and is raised by a predetermined height.

For instance, rearward force acts on the drawer 100. Thus, the user needs to continuously apply force in order to discharge the drawer 100, and the drawer 100 is again introduced into the storage compartment 300 by the rearwardly acting force, so long as no force is applied to the drawer 100 during the movement thereof.

The movable support unit 200 remains in the state of being introduced in the storage compartment 300 while being accommodated in the roller accommodating unit 150.

Referring to FIG. 5C, the second slope B of the drawer 100 moves on the second roller unit 330, and the first roller unit 130 moves along the horizontal portion of the first roller guide 350. The drawer 100 is tilted forward and downward as it moves, and the inclination angle of the drawer 100 gradually increases. In other words, the front end portion of the drawer 100 rotates downward about the first roller unit 130, and the inclination angle of the drawer 100 increases via this rotation. As the front end portion of the drawer 100 is lowered, the front roller 231 of the movable support unit 200 is moved from the position at which it is spaced apart from the top support surface 153 so as to be brought into contact with and upwardly press the top support surface 153, thereby supporting the weight of the drawer 100.

The drawer 100 is accelerated by forwardly acting force. For instance, the drawer 100 is automatically discharged by the forwardly acting force even if the user applies no force.

In some examples, since the connecting portion of the first slope A-1 and the second slope B is curved to have a predetermined curvature, the drawer 100 undergoes no rattling during movement.

Referring to FIG. 5D, the third slope C of the drawer 100 moves on the second roller unit 330, and the first roller unit 130 moves along the horizontal portion of the first roller guide 350. The drawer 100 moves in the state of being tilted forward and upward, and the angle of downward inclination thereof gradually decreases.

The drawer 100 moves in the state in which the roller accommodating unit 150 forwardly presses the front roller unit 230. Thus, the movable support unit 200 is discharged from the storage compartment 300 in the state of supporting the weight of the drawer 100.

In some examples, since the connecting portion of the second slope B and the third slope C is curved to have a predetermined curvature, the drawer 100 undergoes no rattling during movement. In addition, the drawer 100 is gradually decelerated by rearwardly acting force. When the second roller unit 330 interferes with the stopper 113, the drawer 100 ends the discharge operation thereof. Since the front end surface of the stopper 113 is curved, the drawer 100 may smoothly stop.

With this configuration, the drawer 100 is initially discharged by a small force and is then accelerated and smoothly discharged without rattling. Thereafter, the drawer 100 is gradually decelerated and smoothly stops without rattling. This discharge operation of the drawer 100 may provide the user with a high-quality sensation of use.

In addition, when the discharge operation ends, the drawer 100 is in the fully discharged state. That is, a part or the entirety of the rear end portion of the drawer 100 is discharged from the storage compartment 300. In addition, the drawer 100 is tilted forward and downward, so that the user may easily view the inside of the drawer 100.

Referring to FIG. 6A, there is illustrated the state in which the user pushes the drawer 100 accommodated in the storage compartment 300 so as to introduce the drawer 100. The introduction operation is performed in the reverse order of the discharge operation. However, there is a difference in that the movable support unit 200 maintains the discharged state thereof and then is introduced into the storage compartment 300 by the front end pressure surface 155.

The front roller unit 230 is in the state of supporting the weight of the drawer 100 and still remains in the discharged state.

Referring to FIG. 6B, the movable support unit 200 is brought into contact with the front end pressure surface 155 and begins to be introduced into the storage compartment 300. As the second slope B moves on the second roller unit 330, the front end portion of the drawer 100 rotates upward. Thus, the front roller unit 230 is downwardly spaced apart from the top support surface 153 and does not support the weight of the drawer 100.

Referring to FIG. 6C, the movable support unit 200 is pressed rearward by the front end pressure surface 155 and is introduced into the storage compartment 300. Since the first slope A-1 moves on the second roller unit 330, the drawer 100 is lowered while maintaining the horizontal state relative to the ground. The movable support unit 200 may support the weight of the drawer 100 via position setting as described above.

As is apparent from the above description, a refrigerator according to the implementations of the present disclosure may have one or more of the following effects.

In some examples, a guide rib, which is provided on the side surface of a drawer, may include realizes various inclinations, which may ensure that a user does not need to continuously apply force in order to introduce or discharge the drawer into or from a storage compartment.

In some examples, based on the various inclinations of the guide rib provided on the side surface of the drawer, the drawer may be tilted forward and downward when discharged to a maximum extent from the storage compartment.

In some examples, a separate member may be located between the drawer and the bottom surface of the storage compartment to support the weight of the drawer, which may secure the maximum capacity of the drawer.

In some examples, the separate member (e.g., a movable support), which supports the weight of the drawer, may be discharged in conjunction with the operation of the drawer, which may prevent the drawer from being separated from the storage compartment due to the weight thereof when discharged to the maximum extent.

In some examples, the drawer may be reduced in price compared to an existing slide rail device.

In some examples, the capacity of the drawer may be maximized by preventing rails from overlapping each other.

Although the exemplary implementations have been illustrated and described as above, of course, it will be apparent to those skilled in the art that the implementations are provided to assist understanding of the present disclosure and the present disclosure is not limited to the above described particular implementations, and various modifications and variations can be made in the present disclosure without departing from the spirit or scope of the present disclosure, and the modifications and variations should not be understood individually from the viewpoint or scope of the present disclosure.

What is claimed is:

1. A refrigerator comprising:

a cabinet that defines a storage compartment and an opening at a front side for the storage compartment;

a drawer located in the storage compartment and configured to discharge from the storage compartment in a discharge direction, the drawer comprising a first roller located at a rear end of the drawer and a guide rib that extends in the discharge direction;

a second roller located at a front portion of the storage compartment and configured to support a bottom surface of the guide rib of the drawer;

first roller guides located at respective side surfaces of the storage compartment that face each other, the first roller guides defining a movement path of the first roller; and a movable support that is located vertically below the drawer in the storage compartment, that is configured to discharge together with the drawer, and that is configured to support the drawer, wherein the guide rib comprises a first portion that extends from a front end of the drawer toward the rear end of the drawer in a direction that slopes downward with respect to a bottom surface of the storage compartment, wherein each first roller guide comprises a rear portion that extends rearward in a direction corresponding to a slope of the first portion of the guide rib with respect to the bottom surface of the storage compartment, and wherein the movable support is disposed between the drawer and the bottom surface of the storage compartment and configured to move relative to the drawer.

2. The refrigerator according to claim 1, wherein the guide rib further comprises a second portion that extends from the first portion toward the rear end of the drawer in a direction that slopes upward relative to the bottom surface of the storage compartment.

3. The refrigerator according to claim 2, wherein the guide rib further comprises a third portion that extends from the second portion toward the rear end of the drawer in a direction that slopes downward with respect to the bottom surface of the storage compartment.

4. The refrigerator according to claim 1, wherein the guide rib comprises a stopper that protrudes downward from a rear end of the guide rib and that is configured to interfere with the second roller.

5. The refrigerator according to claim 1, wherein each first roller guide comprises:

a first lower guide surface located vertically below the first roller; and a first upper guide surface located vertically above the first roller and configured to block separation of the first roller in an upward direction from the first roller guides.

6. The refrigerator according to claim 5, wherein the first upper guide surface comprises a first protrusion that protrudes downward from the first upper guide surface and that extends in a longitudinal direction of the first roller guides, and wherein the first roller has an outer circumferential surface that defines an accommodating groove configured to receive the first protrusion.

7. The refrigerator according to claim 5, wherein the first roller guides are located vertically below the guide rib.

8. The refrigerator according to claim 1, wherein the movable support comprises:

a support frame located at the bottom surface of the storage compartment and configured to discharge forward together with the drawer; and a front roller located at a front portion of the support frame and configured to support the drawer.

9. The refrigerator according to claim 8, wherein the drawer further comprises a roller accommodating portion that defines an open bottom side configured to receive the front roller.

10. The refrigerator according to claim 9, wherein the roller accommodating portion extends rearward from the front end of the drawer by an extension length, and wherein the drawer is configured to discharge forward from the storage compartment by a distance that is greater than the extension length based on the movable support discharging together with the drawer.

11. The refrigerator according to claim 8, wherein the movable support further comprises a rear roller located at a rear portion of the support frame, and wherein the refrigerator further comprises second roller guides that are located at the respective side surfaces of the storage compartment and that define a movement path of the rear roller.

12. The refrigerator according to claim 11, wherein each second roller guide comprises:

a second lower guide surface located vertically below the rear roller; and a second upper guide surface located vertically above the rear roller and configured to block separation of the rear roller in an upward direction from the second roller guides.

13. The refrigerator according to claim 12, wherein the rear roller comprises an upper roller and a lower roller located vertically below the upper roller, each of the upper and lower rollers having an outer circumferential surface that defines a groove, and wherein each second roller guide comprises:

a second lower protrusion that protrudes from the second lower guide surface, that is configured to insert into the groove in the lower roller, and that is configured to guide movement of the lower roller, and a second upper protrusion that protrudes from the second upper guide surface, that is configured to insert into the groove in the upper roller, and that is configured to guide movement of the upper roller.

14. The refrigerator according to claim 1, wherein the guide rib protrudes from the rear end of the drawer, and wherein the first roller protrudes rearward from the rear end of the drawer by a predetermined distance.

15. The refrigerator according to claim 3, wherein the guide rib further comprises a first coupling portion that connects the first portion to the second portion and that is curved by a first curvature.

16. The refrigerator according to claim 15, wherein the guide rib further comprises a second coupling portion that connects the second portion to the third portion and that is curved by a second curvature greater than the first curvature.

17. The refrigerator according to claim 4, wherein the stopper includes a front surface that is curved and that is configured to contact the second roller.

18. The refrigerator according to claim 1, wherein the guide rib comprises a guide protrusion that protrudes from the bottom surface of the guide rib and that extends in a longitudinal direction of the guide rib, and wherein the second roller comprises a roller that has an outer circumferential surface that defines an accommodating groove configured to receive the guide protrusion.

19. The refrigerator according to claim 3, wherein the guide rib comprises a guide protrusion that protrudes from the bottom surface of the guide rib and that extends toward the rear end of the drawer along the directions of the first, second, and third portions.

20. The refrigerator according to claim 10, wherein the roller accommodating portion includes a rear end surface that is spaced apart from the front end of the drawer by the extension length, and that is configured to receive pressure from the front roller based on the movable support discharging together with the drawer.

* * * * *